US007146943B2

(12) United States Patent
Sedda et al.

(10) Patent No.: US 7,146,943 B2
(45) Date of Patent: Dec. 12, 2006

(54) ELECTROMECHANICAL VALVE ACTUATOR FOR INTERNAL COMBUSTION ENGINES AND INTERNAL COMBUSTION ENGINE EQUIPPED WITH SUCH AN ACTUATOR

(75) Inventors: Emmanuel Sedda, Sainte Honorine (FR); Christophe Fageon, Montrouge (FR); Stephane Guerin, La Gareene Colombes (FR); Jean-Paul Yonnet, Meylan (FR)

(73) Assignee: Peugeot Citroen Automobiles SA, Velizy-Villacoublay Cedex (FR)

( * ) Notice: Subject to any disclaimer, the term of this patent is extended or adjusted under 35 U.S.C. 154(b) by 358 days.

(21) Appl. No.: 10/780,153

(22) Filed: Feb. 17, 2004

(65) Prior Publication Data

US 2004/0206319 A1 Oct. 21, 2004

(30) Foreign Application Priority Data

Feb. 18, 2003 (FR) ..... 03 01944

(51) Int. Cl.
*F01L 9/04* (2006.01)

(52) U.S. Cl. ..... 123/90.11; 123/90.15; 251/129.1; 251/129.15

(58) Field of Classification Search ..... 123/90.11, 123/90.15; 251/129.01, 129.1, 129.6, 129.15, 251/129.16

See application file for complete search history.

(56) References Cited

U.S. PATENT DOCUMENTS

| | | | | |
|---|---|---|---|---|
| 3,858,135 | A | 12/1974 | Gray | |
| 4,533,890 | A | 8/1985 | Patel | |
| 4,715,332 | A | 12/1987 | Kreuter | |
| 6,184,767 | B1 * | 2/2001 | Pischinger et al. | 335/256 |
| 6,198,370 | B1 | 3/2001 | Schmitz | |
| 6,216,653 | B1 | 4/2001 | Okada et al. | |
| 6,308,667 | B1 * | 10/2001 | Tsai et al. | 123/90.11 |

FOREIGN PATENT DOCUMENTS

| | | | |
|---|---|---|---|
| DE | 35 00 530 | A | 7/1986 |
| DE | 100 03 928 | A | 6/2001 |
| EP | 0 422 228 | A1 | 4/1991 |
| EP | 0 504 806 | A | 9/1992 |
| EP | 0 816 644 | A2 | 1/1998 |
| EP | 1 010 866 | A2 | 6/2000 |
| EP | 1 174 595 | A | 1/2002 |
| EP | 1 174 596 | A | 1/2002 |
| EP | 1 264 969 | A2 | 12/2002 |
| FR | 2 784 497 | A | 4/2000 |
| FR | 2 822 585 | A | 9/2002 |
| JP | 2001-035721 | A | 2/2001 |
| JP | 2002 130510 | A | 5/2002 |

OTHER PUBLICATIONS

French Search Report dated Oct. 28, 2003 (2 pages).

* cited by examiner

*Primary Examiner*—Thomas Denion
*Assistant Examiner*—Zelalem Eshete
(74) *Attorney, Agent, or Firm*—RatnerPrestia

(57) ABSTRACT

An electromechanical valve actuator for internal combustion engines is equipped with a polarized electromagnet exerting a magnetic action on a magnetic plate that is subject to a mechanical restoring action, which action can compensate for the mechanical action and maintain the plate in a distant position from the electromagnet. The actuator ensures that the displacements of the plate are controlled solely by this electromagnet and the mechanical restoring action such that the plate performs shuttle movements beginning from the distant position.

8 Claims, 4 Drawing Sheets

ELECTROMECHANICAL VALVE ACTUATOR FOR INTERNAL COMBUSTION ENGINES AND INTERNAL COMBUSTION ENGINE EQUIPPED WITH SUCH AN ACTUATOR

FIELD OF THE INVENTION

The present invention pertains to an electromechanical valve actuator for internal combustion engines and to an internal combustion engine equipped with such an actuator.

BACKGROUND

An electromechanical actuator (FIG. 1) for a valve 110 comprises mechanical means, such as springs 102 and 104, and electromagnetic means, such as electromagnets 106 and 108, for controlling the position of the valve 110 by means of electric signals.

The rod of the valve 110 is applied for this purpose against the rod 112 of a magnetic plate 114 located between the two electromagnets 106 and 108.

When current flows in the coil 109 of the electromagnet 108, the latter is activated and attracts the magnetic plate 114, which comes into contact with it in the so-called "upper" position.

The simultaneous displacement of the rod 112 enables the spring 102 to bring the valve 110 into the closed position, the head of the valve 110 moving against its seat 111 and preventing the exchange of gas between the interior and the exterior of the cylinder 117.

Analogously (not shown), when current flows in the coil 107 of the electromagnet 106 (the electromagnet 108 being deactivated), it is activated and attracts the plate 114, which comes into contact with it and displaces the rod 112, compressing the spring 102, by means of the spring 104, such that this rod 112 acts on the valve 110 and brings the latter into the open position, the head of the valve being moved away from its seat 111 to permit, for example, the admission or the injection of gas into the cylinder 117. The valve is now in the so-called "lower" position.

Thus, the valve 110 and the plate 114 alternate between fixed, so-called switched positions, with transient displacements between these two positions.

The actuator 100 may also be equipped with magnets 118 (electromagnet 108) and 116 (electromagnet 106) intended to reduce the energy necessary to maintain the plate 114 in a switched position, i.e., in contact with one of the electromagnets. Such electromagnets will hereinafter be called electromagnets with a magnet or polarized electromagnets.

The prior-art actuators have the drawback of requiring a considerable amount of energy to maintain the valve in a switched position, even though this maintenance does not supply any propulsion energy for the vehicle.

In addition, they generate a considerable operating noise due to the contact between the plate and the electromagnet.

SUMMARY OF THE INVENTION

The present invention remedies at least one of these drawbacks. It results from the observation that the action exerted by an electromagnet on a plate can be controlled more accurately and with a greater range if this electromagnet is polarized, as will be explained below on the basis of FIG. 2.

This FIG. 2 shows the forces F (ordinate 200, in N) exerted on a magnetic plate by a polarized electromagnet (curve $\mathbf{202}_1$) and by a nonpolarized electromagnet (curve 206) supplied with the same current as a function of the air gap e (abscissa 208, in mm) separating the electromagnet from the plate.

It is seen that the force F exerted by the nonpolarized electromagnet (curve 206) supplied with a current i decreases sharply as a function of the air gap.

In fact, the force exerted by a nonpolarized electromagnet is nonlinear, namely, inversely proportional to the second power of the air gap, and proportional to the second power of the intensity of the current supplying the electromagnet.

Inversely, the force exerted by the actuator decreases less rapidly as a function of the air gap e in the case of a polarized electromagnet supplied with a current i (curve $\mathbf{202}_1$) identical to that used previously.

Thus, the variation in the force exerted by the polarized electromagnet is more linear than the variation in the force exerted by the nonpolarized electromagnet, which makes possible a better control of this force in the course of the displacement of the plate.

It should be pointed out that if the plate is saturated by a magnetic field originating from the electromagnet, the force exerted by the latter increases less sharply when the air gap decreases, as is shown by curve $\mathbf{202}_1'$ of curve $\mathbf{202}_1$.

The present invention also results from the observation that the force exerted by a polarized electromagnet on a magnetic plate can compensate the mechanical restoring force to which the plate is subjected even when this plate is distant from the electromagnet.

The force exerted by the electromagnet for different decreasing supply currents (curves $\mathbf{202}_2$, $\mathbf{202}_3$ and $\mathbf{202}_4$) as well as the mechanical force exerted by the springs on the plate (curve 210) as a function of the distance or air gap separating the latter from the electromagnet are determined for this purpose.

It appears that if the air gap has such a value that the rod of the valve is distant from the end of the rod of the magnetic plate, the force exerted by the polarized electromagnet must equal only the mechanical action exerted by the restoring spring that is an integral part of the plate, the spring that is an integral part of the rod of the valve being blocked by the switched position of the valve.

For example, by supplying the electromagnet with a current corresponding to curve $\mathbf{202}_3$, the force exerted by this electromagnet equals the mechanical force for an air gap smaller than the value of the timing clearance.

Finally, the present invention results from the observation that the maintenance of a valve in a switched position requires a considerable power supply, even though this maintenance is not necessary for operating the gas admission and/or exhaust steps vis-a-vis the cylinder.

Therefore, the present invention pertains to an electromechanical valve actuator for internal combustion engines, equipped with a polarized electromagnet exerting a magnetic action on a magnetic plate subjected to a mechanical restoring action, where this action can compensate the mechanical action and maintain the plate in a distant position from the electromagnet, characterized in that the actuator comprises means for the displacement of the plate to be controlled solely by this electromagnet and the mechanical restoring action, such that the plate performs shuttle movements starting from the distant position.

Due to the present invention, the contacts between the plate and the electromagnet are suppressed, and the functioning of the actuator generates greatly reduced noise.

In addition, by controlling the displacement of the plate by means of a single electromagnet, the power consumption of the actuator is reduced.

According to one embodiment, the actuator comprises means to ensure that the distant position of the plate corresponds to an open position of the valve.

In one embodiment, the actuator comprises means for moving the distant plate away from the electromagnet by annulling or inverting the direction of the supply current of the electromagnet.

In one embodiment, the plate is maintained at such a distance that the rod of the valve is distant from a rod of the plate controlling this valve.

In such an embodiment in which the electromagnet has the shape of an E equipped with a central branch and two end branches, the plate has a cross section smaller than the cross section of the end branches and/or smaller than the cross section of the central branch.

According to one embodiment, the electromagnet being E-shaped, a magnet is fixed at the end of these branches opposite the plate.

In one embodiment, the mechanical restoring action is generated by at least one spring.

The present invention also pertains to an internal combustion engine equipped with an electromechanical valve actuator for internal combustion engines, comprising a polarized electromagnet and a mobile magnetic plate subjected to a mechanical restoring action. According to the present invention, the actuator is according to one of the above embodiments.

BRIEF DESCRIPTION OF THE DRAWINGS

Other features and advantages of the present invention will become apparent from the description of embodiments of the present invention, which will be presented below as a nonlimiting example in reference to the figures attached, in which.

DETAILED DESCRIPTION

Figure 1:
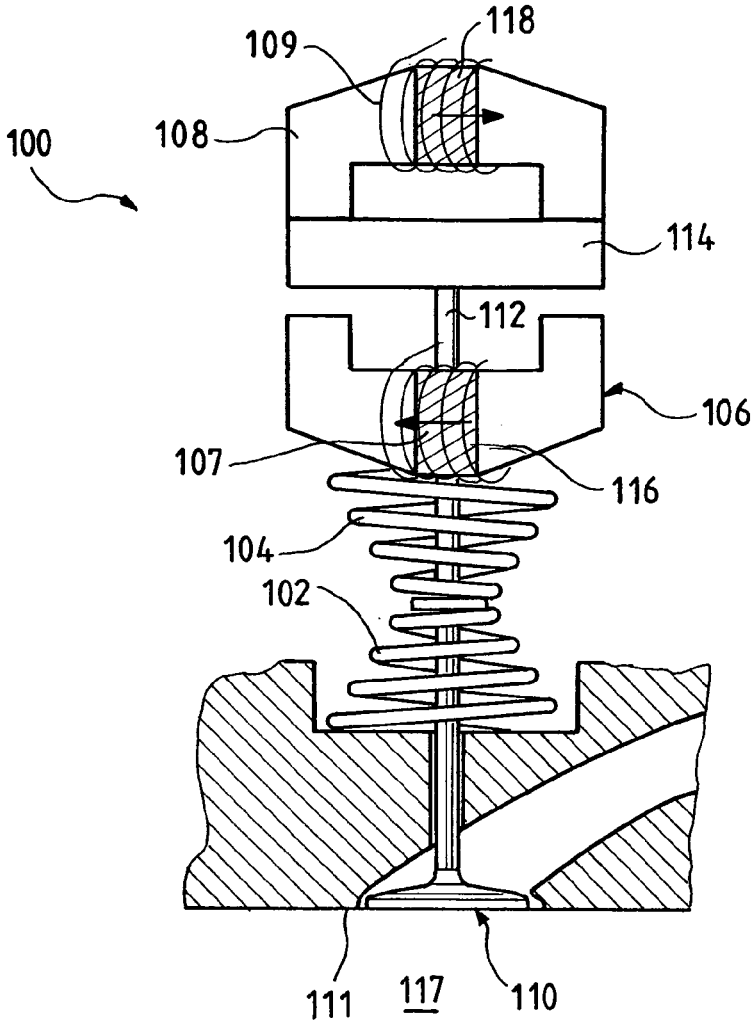
FIG. 1, already described, shows a prior-art actuator.
Figure 6:
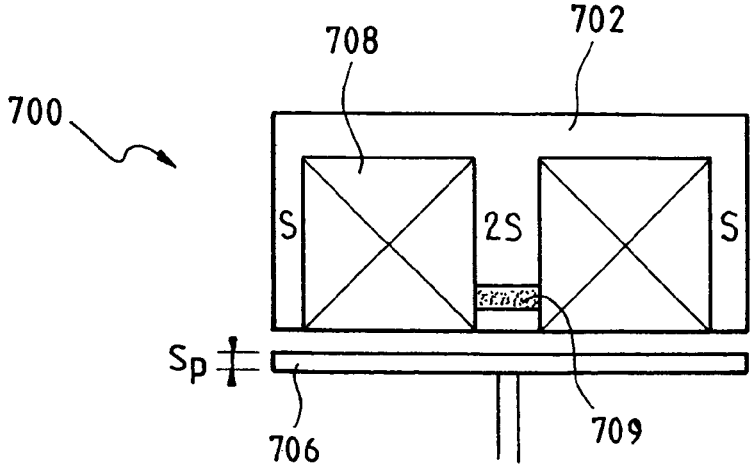
Figure 3:
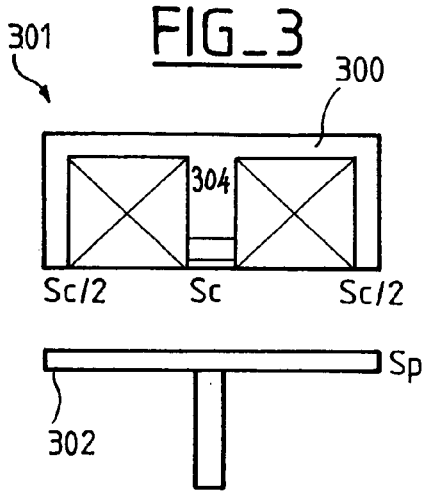
FIG. 3 shows an actuator that can be controlled according to the present invention.

In the embodiment of the present invention shown in FIG. 3, an actuator 301 comprises an E-shaped electromagnet 300 and a mobile magnetic plate 302 in the vicinity of the electromagnet 300.

A magnetic circuit is formed, on the one hand, by the central branch 304, which has a cross section $S_c$, and the end branches 306, which have a cross section $S_{c/2}$, of the electromagnet 300, and, on the other hand, by the plate 302, which has a cross section $S_p$.

However, to increase the force exerted by the polarized electromagnet on the plate, the magnetic flux generated by the electromagnet can be concentrated by reducing the cross section of the end sections 306 of the electromagnet such that the central cross section $S_c$ of the electromagnet will be more than twice the cross section $S_c$ of the ends.

Such a flux concentration makes it possible to obtain considerable inductions in the air gap with the use of magnets of a weak remanent field, such as magnets made of ferrite or composites.

The cross section $S_p$ of the plate is also equal to the cross section $S_{c/2}$ of the magnetic circuit in order to reduce the mass of the plate.

Thus, springs (not shown) of low rigidity can be used to control a plate having a limited mass. Consequently, the power consumption required to displace the plate is reduced.

As a corollary, the control exerted on the plate by the electromagnet by means of the field generated is increased because the intensity of the mechanical action opposed to this magnetic action decreases.

Such an improvement of the control of the plate makes it possible, for example, to control the velocity of approach of the plate against the electromagnet or to modify the switching time of the plate.

Finally, the size of the electromagnet is no longer dictated in terms of height by the cross section of the magnet.

Figure 4A:
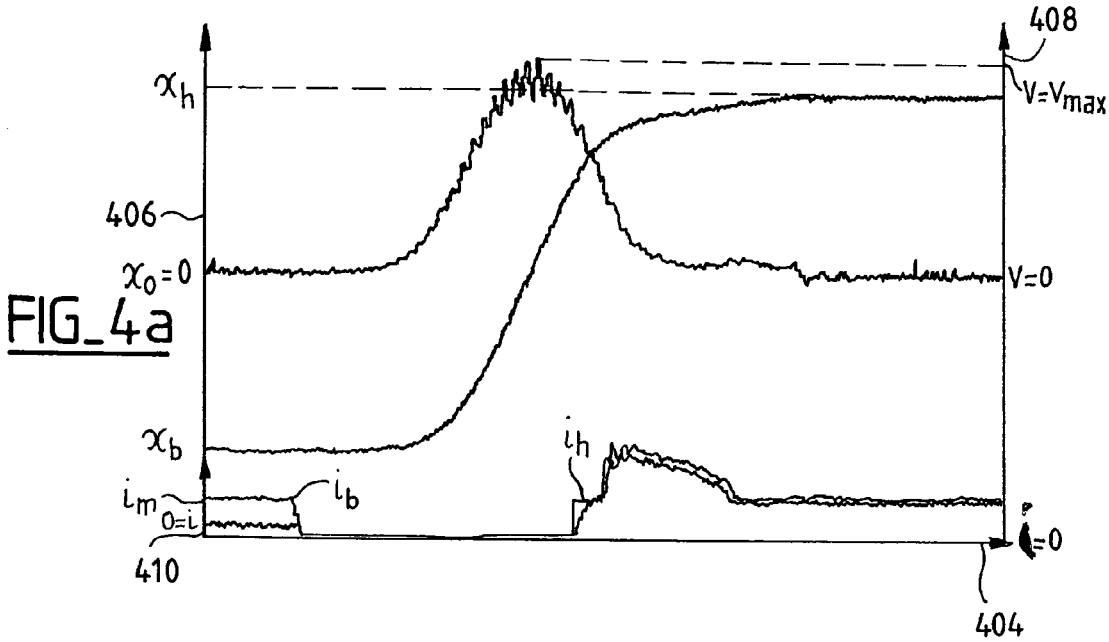
FIGS. 4*a* through 4*d* are diagrams showing different operations of the actuator shown in FIG. 3.
Figure 4B:
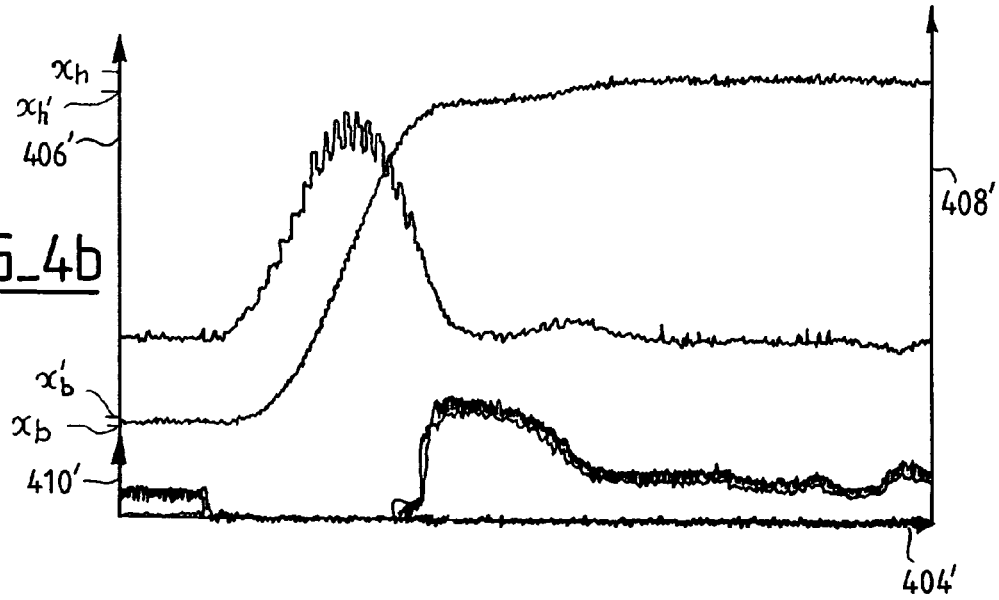
Figure 4C:
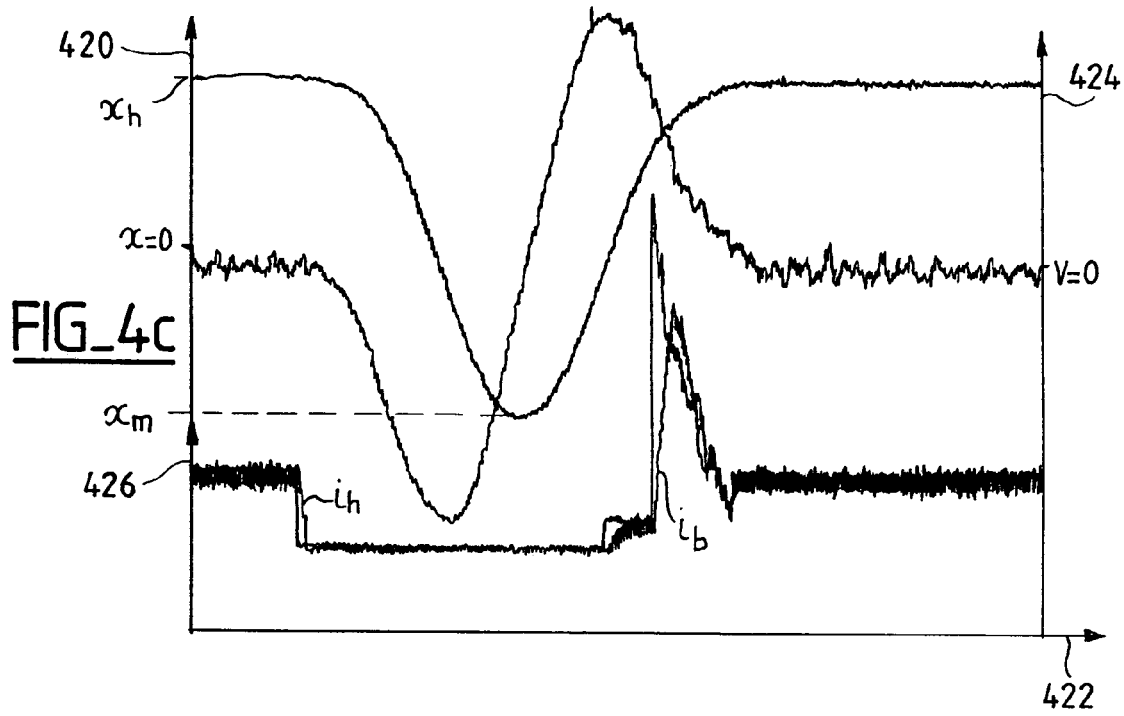
Figure 4D:
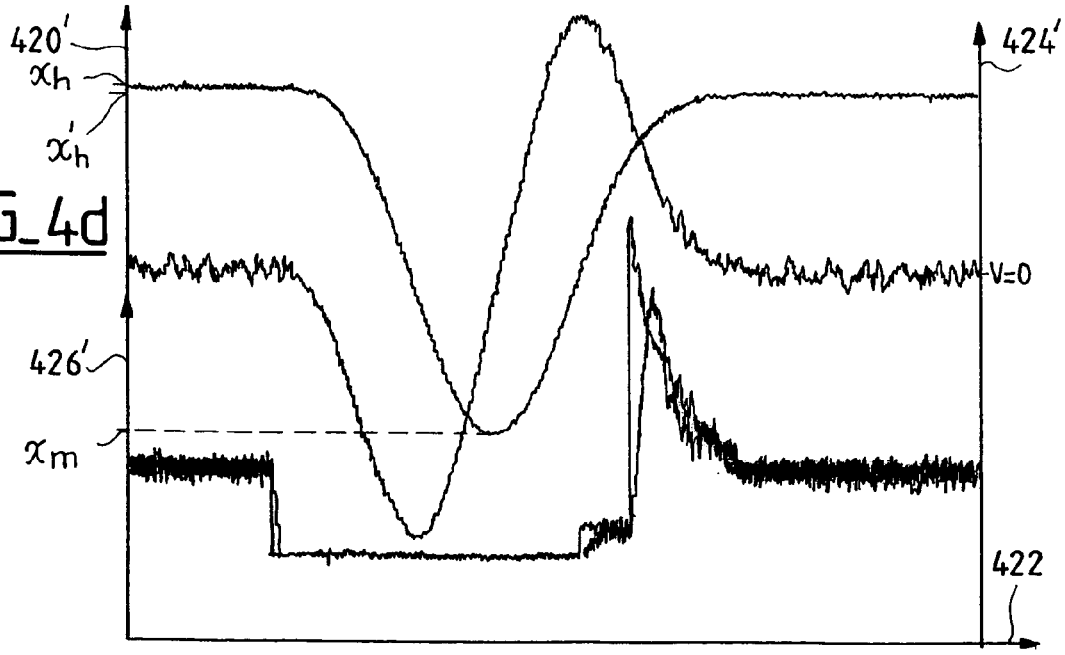

Various measures related to the operation of an actuator equipped with two electromagnets, such as the electromagnet 300, and a magnetic plate, such as the plate 302, are shown in FIGS. 4*a*, 4*b*, 4*c* and 4*d* depending on whether this mode of operation is according to the present invention (FIGS. 4*b* and 4*d*) or not (FIGS. 4*a* and 4*c*).

A first mode of operation, called switching with docking, is described on the basis of FIG. 4*a*. According to this mode, the plate is located between two consecutively activated electromagnets in order to maintain this plate in contact with them.

Position x (axis 406, in mm) of the plate is shown in FIG. 4*a* as a function of the chronology (abscissa 404, in msec) of the displacement of the plate, measured in relation to its equidistant position (x=0) between the two electromagnets (median position).

It is seen that the plate switches between a first, minimum position $x_b$ and a second, maximum position $x_h$, which correspond to the position of the plate in contact with the lower electromagnet and to the position of the plate in contact with the upper electromagnet, respectively.

The velocity v of the plate (axis 408) varies in agreement with this displacement such that in contact with the lower electromagnet or the upper electromagnet, this velocity is zero, whereas it has its maximum when the plate is more or less equidistant from these two electromagnets.

Finally, the value of the current $i_b$ flowing in the coil of the lower electromagnet and the value of the current $i_h$ flowing in the coil of the upper electromagnet are shown on the axis 410. It is thus seen that to maintain the plate in contact with these electromagnets, each electromagnet is supplied with a holding current $i_m$.

A second mode of operation of the actuator is described on the basis of FIG. 4*b*. According to this mode, the above-described plate is controlled by means of the consecutive activations of the electromagnets, as described by means of FIG. 4*a*, but the plate is maintained at a distant position from the electromagnets according to the present invention. The plate being maintained at a distant position by an electromagnet will hereinafter called a levitation plate.

In fact, it is seen that the minimum position $x'_b$ of the plate has a value higher than the value $x_b$ which the plate had when it came into contact with the lower electromagnet. In other words, the lower electromagnet maintains the distant switched plate in levitation.

Analogously, the upper electromagnet maintains the plate at a distant position in its vicinity such that the maximum position $x'_h$ has a value lower than the value $x_h$ the plate had when it came into contact with the upper electromagnet (FIG. 4*a*).

The velocity v of the plate (axis 408') also reaches an extreme value in this second mode of operation when the plate is more or less in its equidistant position (x=0) between the two switched positions, whereas the intensity (axis 410') of the currents $i'_b$ or $i'_h$ supplying the lower electromagnet and the upper electromagnet of the actuator, respectively; increases when the plate is approaching the electromagnet to attract and stabilize the latter.

This current decreases sharply as the plate tends towards the electromagnet because the magnetic field generated ensures, partially or completely, the maintenance of the plate in levitation.

A third mode of operation, the so-called ballistic mode with docking, is described by means of FIG. 4*c*. According to this third mode, the displacements of the plate between two electromagnets are controlled only by the activation of a single one of these electromagnets, as will be explained below.

Position x (axis 420, in mm) of the plate varies as a function of the time (abscissa 422, in msec) beginning from its first, maximum position $x_h$ toward a second, minimum position $x_b$ corresponding to the position of the plate in contact with the upper electromagnet and to the position in which the plate is closest to the lower electromagnet, respectively.

In fact, the plate performs a shuttle movement starting from the upper electromagnet such that its velocity v (axis 424) increases when it tends toward the lower electromagnet and then reverses when the plate is moving away from this lower electromagnet to return to the upper electromagnet.

Such a ballistic control mode makes it consequently possible, as is shown on axis 426, that only the upper electromagnet will need to consume power $i_h$ to control the plate.

According to a fourth mode of operation according to the present invention, the ballistic control of the plate is combined with a levitation of this plate by the upper electromagnet.

In fact, it is seen that the maximum position $x'_h$ (FIG. 4*d*) of the plate has a value lower than the value $x_h$ of the plate if the latter came into contact with the upper electromagnet (FIG. 4*c*).

The velocity v of the plate (axis 408') also reaches an extreme value in this fourth mode of operation when the plate passes over its equidistant position (x=0) between the two switched positions, whereas the intensity (axis 410') of the currents $i'_b$ or $i'_h$ supplying the lower electromagnet and the upper electromagnet, respectively, increases when the plate is approaching the electromagnet to attract and stabilize the latter.

This current decreases sharply as the plate tends toward the electromagnet because, according to the present invention, the magnetic field generated by the magnet ensures, at least partially, that the plate will be maintained in levitation.

The measures shown in FIGS. 4*a*, 4*b*, 4*c* and 4*d* are representative of a plurality of measures performed with respect to each mode. It should be noted that the position of the plate varies slightly from one test to another. In other words, the precision of the control of the plate and consequently of the valve is particularly accurate in an engine according to the present invention.

Figure 5A:
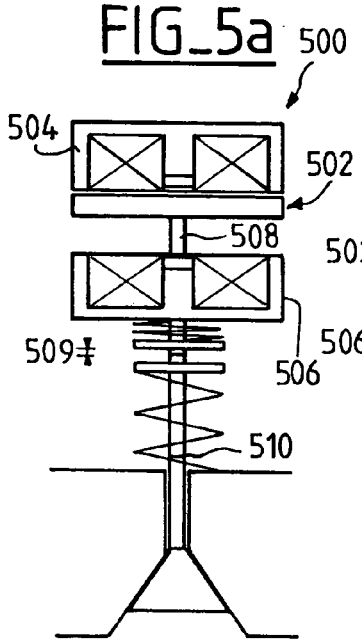
FIGS. 5*a* and 5*b* show two positions of an actuator according to the present invention.
Figure 5B:
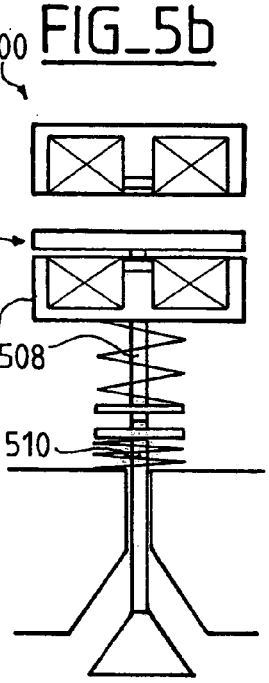
Figure 2:
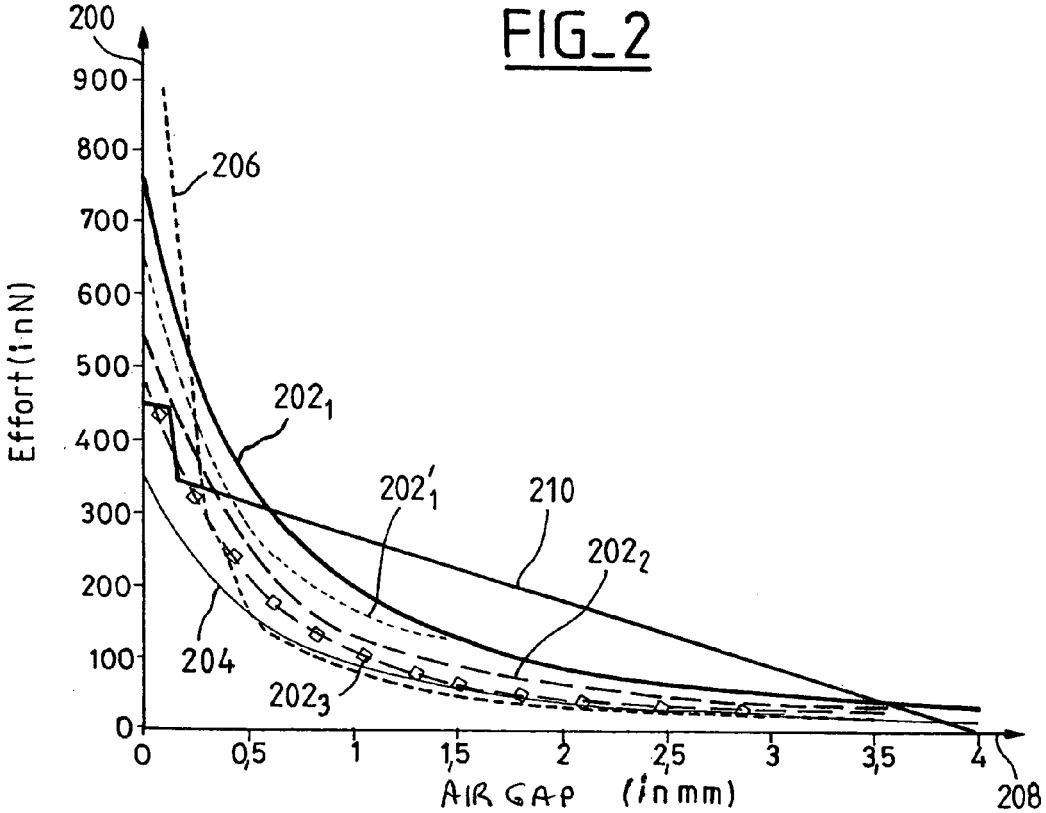
FIG. 2 is a diagram showing the actions exerted on a magnetic plate by different actuators.

Such a precision of control can be used to reduce the shocks between the rod of the plate and the rod of the valve, as was explained on the basis of FIGS. 5*a* and 5*b*, which show the operation of an actuator 500 according to the present invention, the plate 502 being maintained at a distant position from the electromagnets 504 and 506 in its upper (FIG. 5*a*) or lower (FIG. 5*b*) switched position.

In these embodiments, the clearance 509 between the rod 508 of the plate and the rod 510 of the valve is maintained at a low value by the upper electromagnet 504, which maintains the plate in levitation. Thus, when the plate switches toward the upper electromagnet, the contact between the valve rod and the rod of the plate takes place at a velocity that is lower than the velocity that would be obtained if the plate came into contact with the electromagnet, which reduces the noise of this contact.

The present invention may have numerous variations. For example, it is possible to arrange a magnet on the plate such that the latter will generate a field maintaining the plate at a distant position from the electromagnet.

The use of the present invention also makes it possible to use an inlet valve actuator that is different from an exhaust valve actuator.

In fact, it is known that an inlet valve requires an actuator of a lower power than does an exhaust valve.

Nevertheless, the operation of a cold inlet valve actuator, i.e., for the first switchings, requires a power comparable to that required by an exhaust valve actuator. In fact, the maintenance of the valve in the switched positions is more difficult for the first, cold switchings because of problems with the plate sticking to the electromagnet.

Due to the present invention, an inlet valve actuator can be dimensioned for providing a standard maintenance power, given that the maintenance of the valve in the cold state is ensured by the suppression of this maintenance.

In other words, the dimensions of the inlet [valve] actuator can be reduced, thus reducing the mass and the dimensions of the engine.

What is claimed is:

1. An electromechanical valve actuator for internal combustion engines, equipped with a polarized electromagnet exerting magnetic action on a magnetic plate subjected to a mechanical restoring action, which magnetic action tends to compensate the mechanical action and maintains the plate in a distant position from the electromagnet, the actuator comprises means to ensure that the plate operates in a ballistic mode in which displacement of the magnetic plate is controlled only by activation of a single electromagnet and the mechanical restoring action, such that the plate performs shuttle movements starting from the distant position.

2. Actuator in accordance with claim 1, further comprising means to ensure that the distant position of the plate corresponds to an open position of the valve.

3. Actuator in accordance with claim 1 or 2, further comprising means to move the plate away from the electromagnet by annulling or inverting a supply current of the electromagnet.

4. Actuator in accordance with claim 1 or 2, wherein the plate is maintained at such a distance that a rod of the valve is distant from a rod of the plate controlling the valve.

5. Actuator in accordance with claim 1 or 2, wherein the electromagnet has a shape of an E provided with a central branch and two end branches, the plate has across section which is one of smaller than a cross section of the end branches and smaller than half a cross section of the central branch.

6. Actuator in accordance with claim 1 or 2, wherein the electromagnet has an E-shape and, at least one magnet is fixed at the end of at least one of the branches of the E-shaped electromagnet opposite the plate.

7. Actuator in accordance with claim 1 or 2, wherein the mechanical restoring action is generated by at least one spring.

8. Internal combustion engine equipped with an electromechanical valve actuator, comprising a polarized electromagnet and a mobile magnetic plate subjected to a mechanical restoring action, wherein the actuator is according to claim 1 or 2.

* * * * *